US011970319B2

(12) United States Patent
Owen

(10) Patent No.: US 11,970,319 B2
(45) Date of Patent: Apr. 30, 2024

(54) ANTI-ROTATIONAL AND REMOVAL CLOSURE

(71) Applicant: Closure Systems International Inc., Indianapolis, IN (US)

(72) Inventor: Robert H. Owen, Crawfordsville, IN (US)

(73) Assignee: Closure Systems International Inc., Indianapolis, IN (US)

( * ) Notice: Subject to any disclaimer, the term of this patent is extended or adjusted under 35 U.S.C. 154(b) by 71 days.

(21) Appl. No.: 17/741,249

(22) Filed: May 10, 2022

(65) Prior Publication Data

US 2023/0365309 A1 Nov. 16, 2023

(51) Int. Cl.
*B65D 50/04* (2006.01)
*B65D 41/04* (2006.01)

(52) U.S. Cl.
CPC ..... *B65D 50/046* (2013.01); *B65D 41/0471* (2013.01); *B65D 2215/02* (2013.01); *B65D 2543/00092* (2013.01); *B65D 2543/00296* (2013.01)

(58) Field of Classification Search
CPC ..... B65D 50/046; B65D 41/0471; B65D 2215/02
USPC ..... 215/318, 330
See application file for complete search history.

(56) References Cited

U.S. PATENT DOCUMENTS 2,162,880 A 6/1939 Brown
2,423,582 A 7/1947 Coleman
3,147,876 A 9/1964 Lepore
3,160,327 A 12/1964 Porcelli
3,199,702 A 8/1965 Fischbach
3,282,477 A 11/1966 Henchert
3,295,708 A 1/1967 Wathen
3,371,813 A * 3/1968 Owen ..... B65D 41/0457 215/334
3,405,831 A 10/1968 Hudson
3,415,403 A 12/1968 Bardell
3,620,400 A 11/1971 Brown
(Continued)

FOREIGN PATENT DOCUMENTS

EP 0 008 190 A1 2/1980
EP 1 923 318 A2 5/2008
(Continued)

OTHER PUBLICATIONS

International Search Report and Written Opinion in International Patent Application No. PCT/US2023/020179, dated Aug. 18, 2023, 11 pages

*Primary Examiner* — James N Smalley
(74) *Attorney, Agent, or Firm* — NIXON PEABODY LLP

(57) ABSTRACT

A closure for use with a container in which the closure includes a polymeric top portion and a polymeric annular skirt portion. The skirt portion depends from the top portion. The skirt portion includes exterior and interior surfaces. The interior surface of the skirt portion includes crushable ribs and anti-rotational lugs. The crushable ribs are configured to be crushed when the closure is applied to the container so as to prevent or inhibit axial movement of the closure with respect to the container by forming an interference fit. At least one of the plurality of anti-rotational lugs prevents or inhibits rotational movement of the closure with respect to the container such that the closure remains on the container.

26 Claims, 11 Drawing Sheets

(56) References Cited

U.S. PATENT DOCUMENTS 3,667,638 A 6/1972 Cambio, Jr.
3,682,345 A 8/1972 Baugh
3,741,421 A 6/1973 Wittwer
3,904,061 A 9/1975 Keeler
3,987,921 A 10/1976 Aichinger
4,007,848 A 2/1977 Snyder
RE29,850 E 11/1978 Labarre
4,171,749 A 10/1979 Obrist
4,180,175 A 12/1979 Virog
4,345,690 A 8/1982 Hopley
4,345,691 A 8/1982 Burke
4,382,521 A 5/1983 Ostrowsky
4,418,828 A 12/1983 Wilde
4,423,820 A 1/1984 Vangor
4,427,126 A 1/1984 Ostrowsky
4,456,137 A 6/1984 Lyman
4,458,822 A 7/1984 Ostrowsky
4,461,394 A 7/1984 Sendel
4,470,513 A 9/1984 Ostrowsky
4,497,765 A 2/1985 Wilde
4,505,401 A 3/1985 Berglund
4,506,795 A 3/1985 Herr
4,533,062 A 8/1985 Krautkramer
4,534,480 A 8/1985 Santostasi
4,550,844 A 11/1985 Lininger
4,562,931 A 1/1986 Brach
4,573,601 A 3/1986 Berglund
4,592,476 A 6/1986 Yasada
4,609,115 A 9/1986 Moore
4,630,743 A 12/1986 Wright
4,635,808 A 1/1987 Nolan
4,638,917 A 1/1987 Persch
4,674,643 A 6/1987 Wilde
4,682,702 A 7/1987 Gach
4,697,715 A * 10/1987 Beruvides ..... B05B 11/1045 215/330
4,717,034 A * 1/1988 Mumford ..... B65D 41/0428 215/350
4,721,219 A * 1/1988 Dullabaun ..... B65D 79/0087 215/230
4,738,730 A 4/1988 Urmston
4,747,502 A 5/1988 Luenser
4,813,561 A 3/1989 Ochs
4,818,828 A 4/1989 Curley
4,938,370 A 7/1990 McBride
4,971,212 A 11/1990 Kusz
4,978,017 A 12/1990 McBride
4,993,570 A 2/1991 Julian
4,997,097 A 3/1991 Krautkramer
5,050,753 A 9/1991 Trump
5,167,335 A 12/1992 McBride
5,184,741 A 2/1993 Chevassus
5,190,177 A 3/1993 Collins
5,197,620 A 3/1993 Gregory
5,205,426 A 4/1993 McBride
5,292,020 A * 3/1994 Narin ..... B65D 41/0471 215/331
5,301,849 A 4/1994 Guglielmini
5,307,946 A 5/1994 Molinaro
5,314,085 A 5/1994 Bonet
5,328,044 A 7/1994 Rohrs
5,346,082 A 9/1994 Ochs
5,356,021 A 10/1994 McBride
5,366,774 A 11/1994 Pinto
5,450,972 A 9/1995 Zemlo
5,480,045 A 1/1996 Molinaro
5,501,349 A 3/1996 McCandless
5,551,582 A 9/1996 Robinson
5,564,582 A 10/1996 Kamath
5,588,545 A 12/1996 King
5,676,270 A 10/1997 Roberts
5,692,628 A * 12/1997 Montgomery ..... B65D 1/0246 215/44
5,715,959 A 2/1998 Pfefferkorn
5,735,426 A 4/1998 Babcock
5,755,360 A 5/1998 Elliott
5,782,369 A 7/1998 Tansey
5,785,209 A 7/1998 Guglielmini
5,797,506 A 8/1998 Lehmkuhl
5,800,764 A 9/1998 Smeyak
5,810,207 A 9/1998 Hayashida
5,829,611 A 11/1998 Beck
5,845,798 A 12/1998 Carrier
5,860,542 A 1/1999 Takamatsu
5,875,942 A 3/1999 Ohmi
5,884,790 A 3/1999 Seidita
5,915,574 A 6/1999 Adams
5,915,579 A 6/1999 Przytulla
5,950,850 A 9/1999 Takamatsu
6,006,930 A 12/1999 Dreyer
6,016,931 A 1/2000 Ohmi
6,044,992 A 4/2000 Ma
6,056,136 A 5/2000 Taber
6,085,921 A 7/2000 Brown
6,089,390 A 7/2000 Druitt
6,109,465 A 8/2000 Henning
6,112,923 A 9/2000 Ma
6,116,445 A 9/2000 Ikemori
6,123,212 A 9/2000 Russell
6,202,872 B1 3/2001 Smeyak
6,247,605 B1 6/2001 Fujie
6,276,543 B1 8/2001 German
6,325,225 B1 12/2001 Druitt
6,371,317 B1 4/2002 Krueger
6,484,896 B2 11/2002 Ma
6,527,132 B1 3/2003 Druitt
6,557,714 B2 5/2003 Babcock
6,574,848 B2 6/2003 Fujie
6,673,298 B2 1/2004 Krueger
6,705,479 B2 3/2004 Druitt
6,776,314 B2 8/2004 Odet
6,779,672 B2 8/2004 Kano
6,793,101 B2 9/2004 Shinozaki
6,889,857 B2 5/2005 Francois
6,913,157 B2 * 7/2005 Oh ..... B65D 41/04 220/296
6,991,123 B2 1/2006 Druitt
7,014,055 B2 3/2006 Kano
D530,603 S 10/2006 Lohrman
D547,184 S 7/2007 Kim
7,308,988 B2 12/2007 Yashima
7,344,039 B2 3/2008 Bixler
7,451,898 B2 11/2008 Seidita
D588,915 S 3/2009 Lohrman
7,503,468 B2 3/2009 Druitt
7,607,547 B2 10/2009 Kumata
7,637,384 B2 12/2009 Price
D608,199 S 1/2010 Gross
D610,454 S 2/2010 Lohrman
7,832,579 B2 11/2010 Lohrman
7,942,287 B2 5/2011 King
7,975,864 B2 7/2011 Druitt
8,453,866 B2 6/2013 Kamath
8,485,374 B2 7/2013 Gevers
8,763,380 B2 7/2014 Sata
8,807,360 B2 8/2014 Erspamer
9,085,385 B1 7/2015 Costanzo
9,126,726 B2 9/2015 Edie
D847,633 S 5/2019 Berge
D871,904 S 1/2020 Berge
D871,905 S 1/2020 Kim
11,021,302 B2 6/2021 Edie
2001/0011649 A1 8/2001 Fujie
2001/0015355 A1 8/2001 Adams
2001/0027957 A1 10/2001 Kano
2002/0030031 A1 3/2002 Druitt
2002/0066713 A1 6/2002 Ma
2002/0134747 A1 9/2002 Babcock
2003/0116523 A1 6/2003 Druitt
2004/0060893 A1 4/2004 Kano
2004/0065665 A1 4/2004 Mahdi
2004/0155007 A1 8/2004 Hearld
2004/0238478 A1 12/2004 Druitt

(56) References Cited

U.S. PATENT DOCUMENTS

| | | | | |
|---|---|---|---|---|
| 2005/0189312 | A1 | 9/2005 | Bixler | |
| 2006/0163193 | A1 | 7/2006 | Smeyak | |
| 2006/0255003 | A1 | 11/2006 | Fuchs | |
| 2007/0125785 | A1 | 6/2007 | Robinson | |
| 2007/0131641 | A1 | 6/2007 | Higgins | |
| 2008/0087625 | A1 | 4/2008 | Kumata | |
| 2009/0045158 | A1 | 2/2009 | Suriol | |
| 2009/0159555 | A1 | 6/2009 | Druitt | |
| 2011/0011821 | A1 | 1/2011 | Lohrman | |
| 2017/0349336 | A1 | 12/2017 | Sadiq | |
| 2018/0009979 | A1 | 1/2018 | Nishiyama | |
| 2020/0331663 | A1* | 10/2020 | Edie | B65D 41/0471 |

FOREIGN PATENT DOCUMENTS

| | | | |
|---|---|---|---|
| GB | 1 052 734 | A | 12/1966 |
| GB | 1 054 308 | A | 1/1967 |
| GB | 2 068 912 | A | 8/1980 |
| GB | 1 593 072 | | 7/1981 |
| GB | 2 311 060 | A | 9/1997 |
| JP | 2011-114313 | A | 6/2011 |
| WO | WO 98/50283 | | 11/1998 |
| WO | WO 2002/076839 | A2 | 10/2002 |
| WO | WO 2009/073137 | A1 | 6/2009 |

* cited by examiner

ANTI-ROTATIONAL AND REMOVAL CLOSURE

FIELD OF THE INVENTION

The present invention relates generally to a closure that is configured to work with a container to form a package. More specifically, the present invention relates to an anti-rotational and removal polymeric closure.

BACKGROUND OF THE INVENTION

Polymeric closures have been used in many applications over the years in conjunction with containers. Some containers contain product or contents that are not intended for certain individuals, such as children. These products may include over-the-counter (OTC) medication, vitamins, prescriptions, etc.

Some existing containers with over-the-counter (OTC) medication, vitamins and prescriptions use a threaded neck to mate with a threaded closure. Such containers use a sealed application to an opening of the container for product safety due to the lack of tamper-proof evidence incorporated with the mating assemblies. These sealed applications, which can include metallic or polymeric material, not only add additional expense, but necessitate additional manufacturing equipment and processing.

It would be desirable to provide a closure that overcomes these disadvantages of existing containers by eliminating the sealed application to the opening of the container, while still performing desirable properties of a closure including securely positioning the closure on a container and providing the possibility of tamper-proof evidence.

SUMMARY

According to one embodiment, a closure for use with a container includes a polymeric top portion and a polymeric annular skirt portion. The polymeric annular skirt portion depends from the polymeric top portion. The polymeric annular skirt portion includes an exterior surface and an interior surface. The interior surface of the polymeric annular skirt portion includes a plurality of crushable ribs and a plurality of anti-rotational lugs. The plurality of crushable ribs is configured to be crushed when the closure is applied to the container so as to prevent or inhibit axial movement of the closure with respect to the container by forming an interference fit. At least one of the plurality of anti-rotational lugs prevents or inhibits rotational movement of the closure with respect to the container such that the closure remains on the container.

According to a further configuration of the above implementation, each of the plurality of crushable ribs has a tapered or chamfered end, the tampered or chamfered end being located opposite of the polymeric top portion.

In a further aspect of the above implementation, each of the plurality of crushable ribs has a height at a first end closer to the polymeric top portion that is greater than each of the heights of the plurality of crushable ribs at a second opposing end.

In a further aspect of the above implementation, each of the plurality of crushable ribs has a polygonal cross-sectional shape. For example, each of the plurality of crushable ribs may have a rectangular cross-sectional shape.

In yet a further aspect of the above implementation, the number of the plurality of crushable ribs is from about 3 to about 12 in one embodiment and from about 4 to about 8 in another embodiment.

According to a further configuration of the above implementation, the plurality of anti-rotational lugs includes an arrow-shaped portion.

In a further aspect of the above implementation, each of the plurality of anti-rotational lugs has a tapered or chamfered end, the tampered or chamfered end being located opposite of the polymeric top portion.

In a further aspect of the above implementation, each of the plurality of anti-rotational lugs has a height at a first end closer to the polymeric top portion that is greater than each of the heights of the plurality of anti-rotational lugs at a second opposing end.

In yet a further aspect of the above implementation, each of the plurality of anti-rotational lugs has an exterior side surface being tapered or chamfered at a section closest to the polymeric top portion.

In yet a further aspect of the above implementation, each of the plurality of anti-rotational lugs has an opposing exterior side surface being a substantially vertical wall at a section closest to the polymeric top portion.

In yet a further aspect of the above implementation, the number of the plurality of anti-rotational lugs is from about 3 to about 12. In another embodiment, the number of the plurality of anti-rotational lugs is from about 4 to about 8.

In yet a further aspect of the above implementation, the closure is a one-piece closure.

According to another aspect of the present disclosure, a package comprises a container and a closure. The container has a neck portion defining an opening. The neck portion has an exterior surface and an interior surface. The closure is configured for fitment to the neck portion of the container for closing the opening. The closure includes a polymeric top portion and a polymeric annular skirt portion. The polymeric annular skirt portion depends from the polymeric top portion. The polymeric annular skirt portion includes an exterior surface and an interior surface. The interior surface of the polymeric annular skirt portion includes a plurality of crushable ribs and a plurality of anti-rotational lugs. The plurality of crushable ribs is configured to be crushed when the closure is applied to the container so as to prevent or inhibit axial movement of the closure with respect to the container by forming an interference fit. At least one of the plurality of anti-rotational lugs prevents or inhibits rotational movement of the closure with respect to the container such that the closure remains on the container.

According to a configuration of the above implementation, the container has an external thread formation on the neck portion. For example, the external thread formation may be a continuous helical thread.

The above summary is not intended to represent each embodiment or every aspect of the present invention. Additional features and benefits of the present invention are apparent from the detailed description and figures set forth below.

BRIEF DESCRIPTION OF THE DRAWINGS

Other advantages of the invention will become apparent upon reading the following detailed description and upon reference to the drawings in which.

Figure 1A:
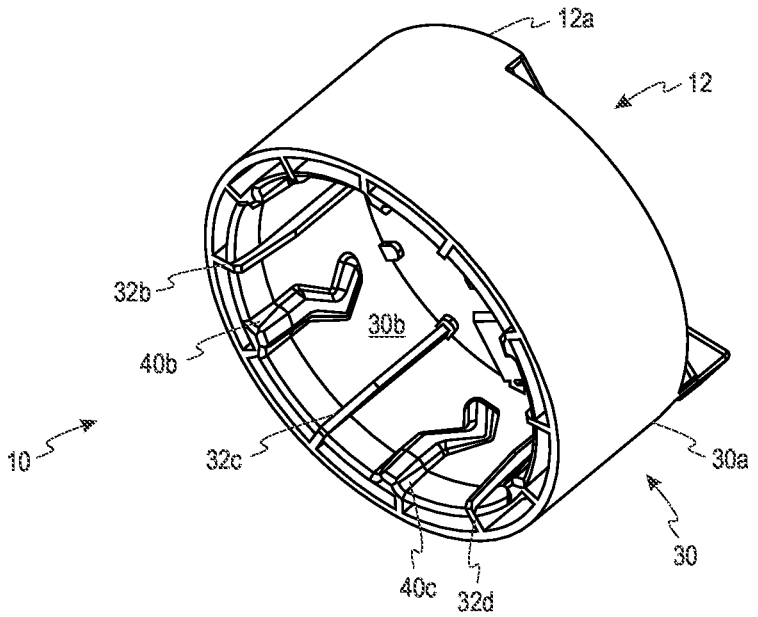
FIG. 1A is a bottom perspective view of a polymeric closure according to one embodiment.

While the invention is susceptible to various modifications and alternative forms, specific embodiments thereof have been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION

Figure 1B:
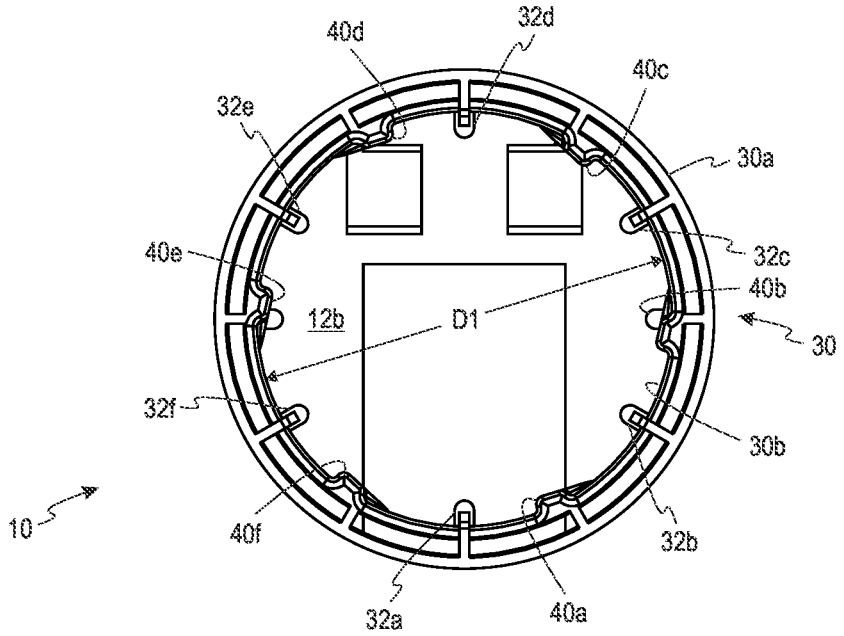
FIG. 1B is a bottom view of the polymeric closure of FIG. 1A.

Referring to FIGS. 1A, 1B, a polymeric closure 10 according to one embodiment is shown. The polymeric closure 10 is a one-piece closure and is configured to not be removable from a container as will be discussed below. Thus, the polymeric closure assists in reducing environmental waste when the container is recycled.

Figure 6A:
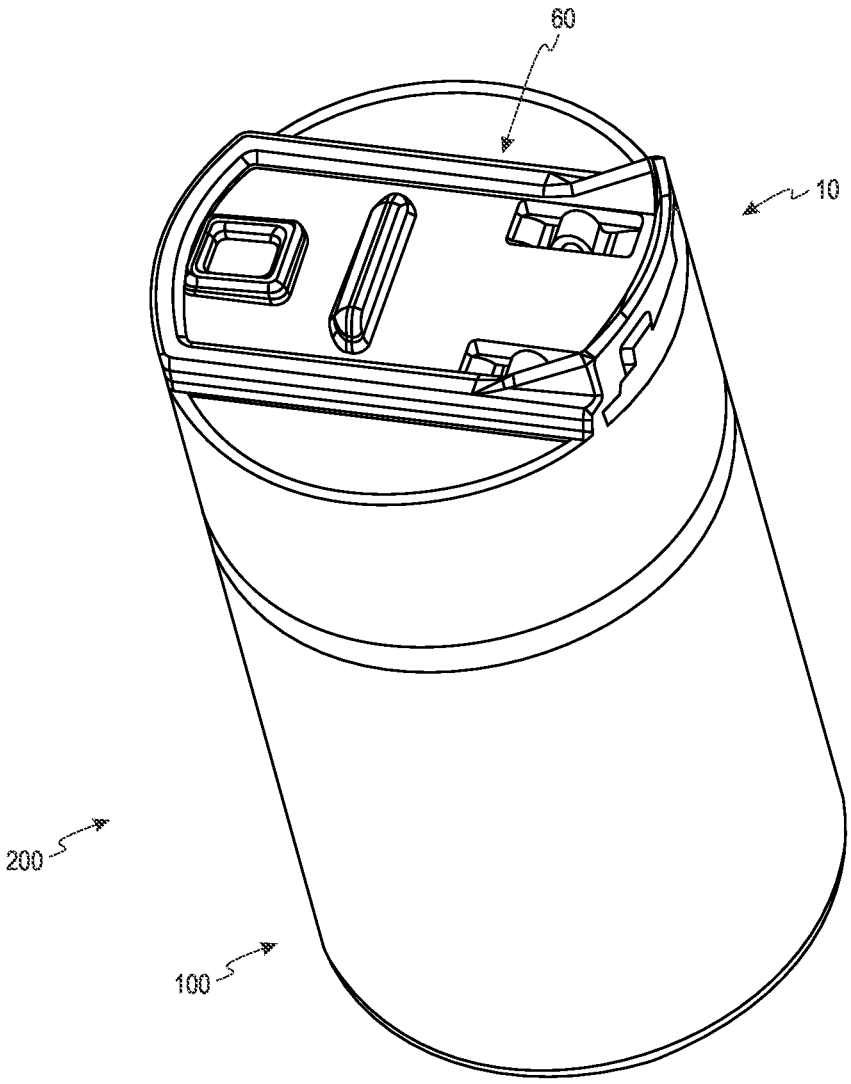
FIG. 6A is a top perspective view of a package including the container of FIG. 4 and the polymeric closure of FIG. 1A in which the package is in a closed position.
Figure 6B:
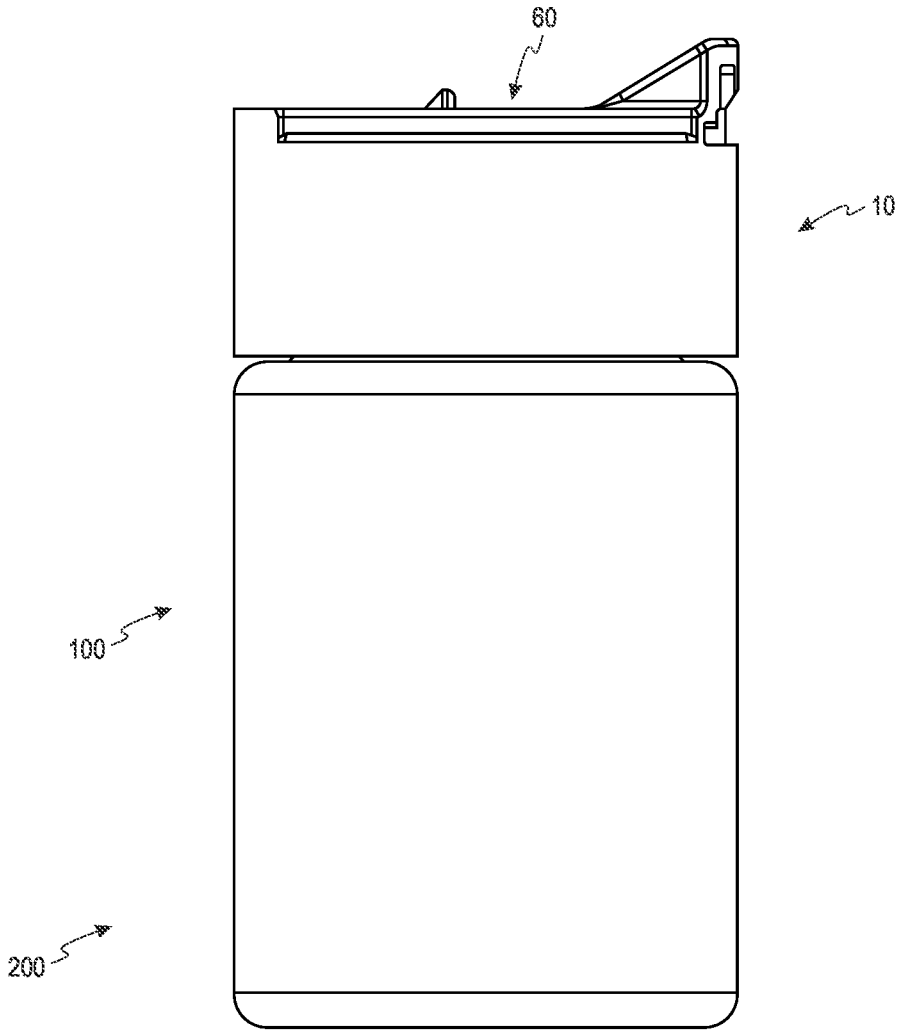
FIG. 6B is a side view of the package of FIG. 6A.
Figure 6C:
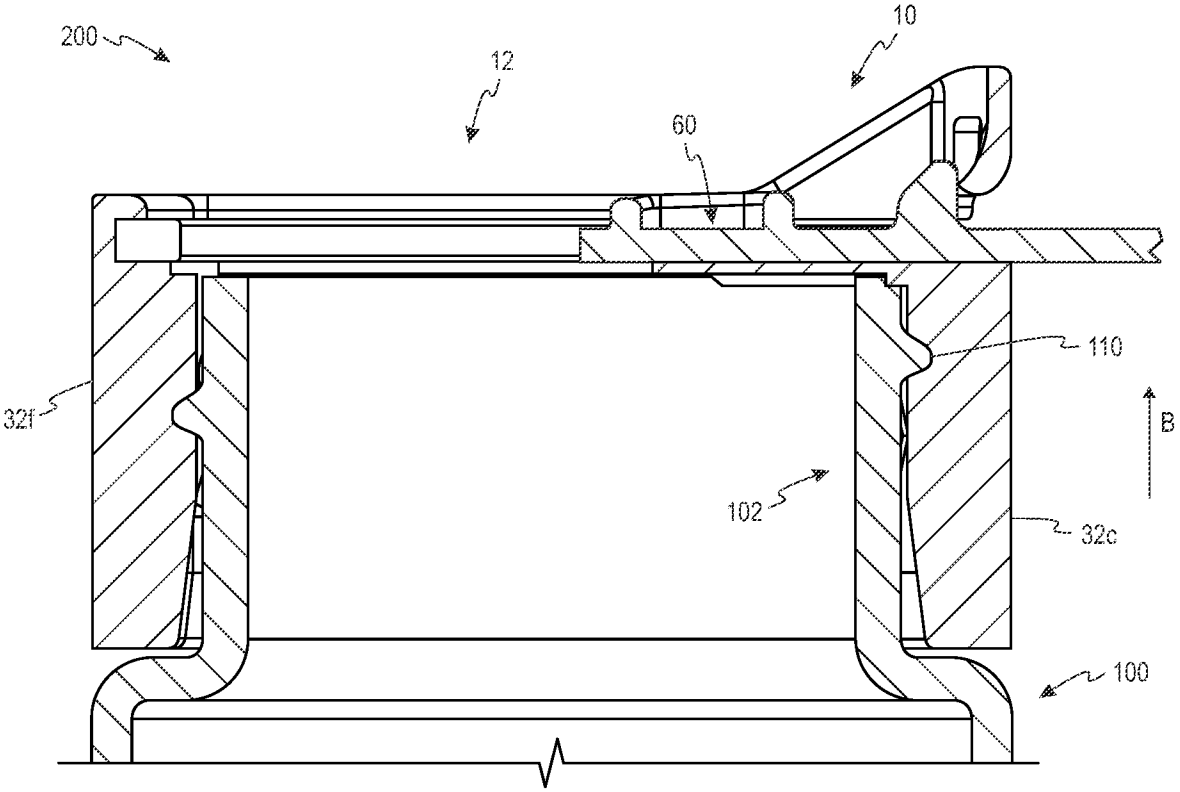
FIG. 6C is a cross-sectional view of a neck portion of the package of FIG. 6A in which the polymeric closure is in an open position.

The polymeric closure 10 is configured for fitment to a neck portion of a container for closing and opening the container. The polymeric closure 10 is configured to be used with a container 100 of FIG. 4 that forms a package 200 as shown in FIGS. 6A-6C.

The polymeric closure of the present invention is advantageous because it saves costs associated with providing and locating a tamper-proof seal on the opening of the container, both from material, inventory and manufacturing process standpoints. The polymeric closure also eliminates potential frustration of an individual when attempting to remove the sealed application from the container, especially for those individuals who have reduced gripping strength, limited dexterity of their upper limbs (e.g., arms or hands), or other disabilities of their upper limbs that make removing the tamper-proof seal from the container difficult.

The polymeric closure 10 of FIGS. 1A, 1B includes a polymeric top portion 12 and a polymeric annular skirt portion 30. The polymeric top portion has an exterior surface 12*a* and an interior surface 12*b*. The polymeric annular skirt portion 30 depends from the polymeric top portion 12. The polymeric annular skirt portion 30 is shown as having an exterior surface 30*a* that is generally smooth. This is advantageous because it is not desirable for a user to have an enhanced grip in an attempt to unthread or force the polymeric closure 10 from the container. It is contemplated, however, that the polymeric annular skirt portion may have a textured exterior surface.

The polymeric annular skirt portion 30 includes the exterior surface 30*a* and an interior surface 30*b*. The interior surface 30*b* of the polymeric annular skirt portion 30 includes a plurality of crushable ribs 32 and a plurality of anti-rotational lugs 40. These are shown in FIG. 1B as crushable ribs 32*a*-32*f* and anti-rotational lugs 40*a*-40*f*. The anti-rotational lugs 40 alternate with the crushable ribs 32 around an interior surface 30*b* of the polymeric annular skirt portion 30.

The combination of the plurality of crushable ribs 32 and the plurality of anti-rotational lugs 40 prevents or inhibits a user from removing the polymeric closure 10 without damaging the polymeric closure 10 or the container.

The plurality of crushable ribs 32 is configured to be crushed when the polymeric closure 10 is applied to the container so as to prevent or inhibit axial movement of the closure with respect to the container as will be discussed in detail below. The plurality of crushable ribs 32, when engaged to the container, applies a radial hoop load and interference fit to an outside diameter of the threaded neck portion of the container.

Figure 2A:
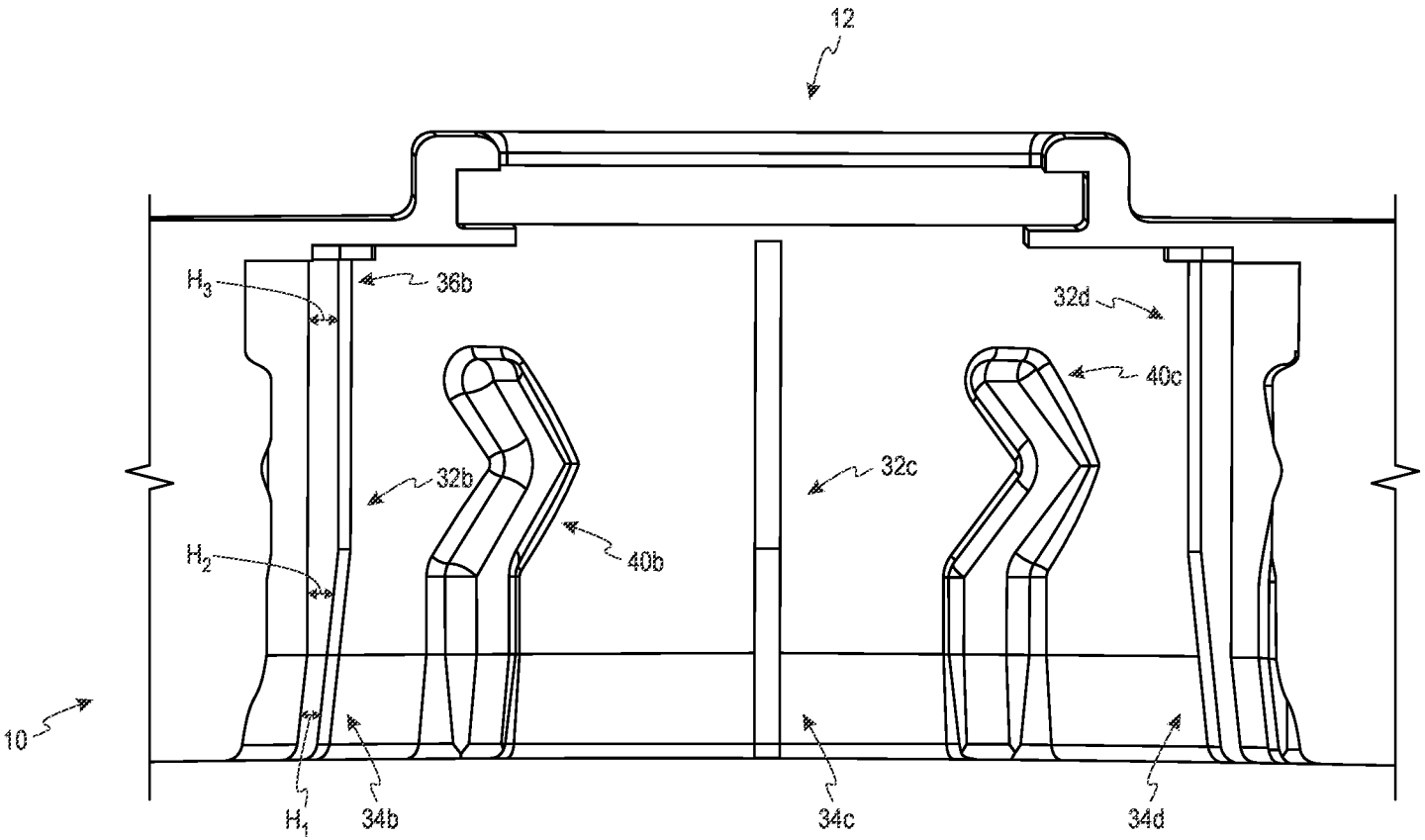
FIG. 2A is an interior side view of the polymeric closure of FIG. 1A according to one embodiment.

Referring to FIG. 2A, a plurality of crushable ribs 32 is shown. Specifically, crushable ribs 32*b*-32*d* are shown in FIG. 2A. To assist in properly centering of the polymeric closure 10 with respect to the container and avoiding potential deflection thereof, leading edges or ends 34*b*-34*d* of respective crushable ribs 32*b*-32*d* are shown as being tapered or chamfered. The leading edges or ends 34*b*-34*d* of the respective crushable ribs 32*b*-32*d* are the edges or ends that are opposite of the top portion 12 of the polymeric closure 10. By having the leading edges or ends 34*b*-34*d* being tapered or chamfered, this assists in more smoothly placing the polymeric closure 10 onto the container.

The tapering or chamfering of the leading edges or ends 34*b*-34*d* of respective crushable ribs 32*b*-32*d* is best shown by comparing heights H1, H2 and H3 in different locations of the crushable rib 32*b*. The height H1 of the crushable rib 32*b* is less than the height H2, and the height H2 is less than the height H3. Thus, the height H3 at an opposing edge or end 36*b* (edge or end nearest the top portion 12 of the polymeric closure 10) has a greater height than the height H1 at the leading edge or end 34*b*.

Figure 5A:
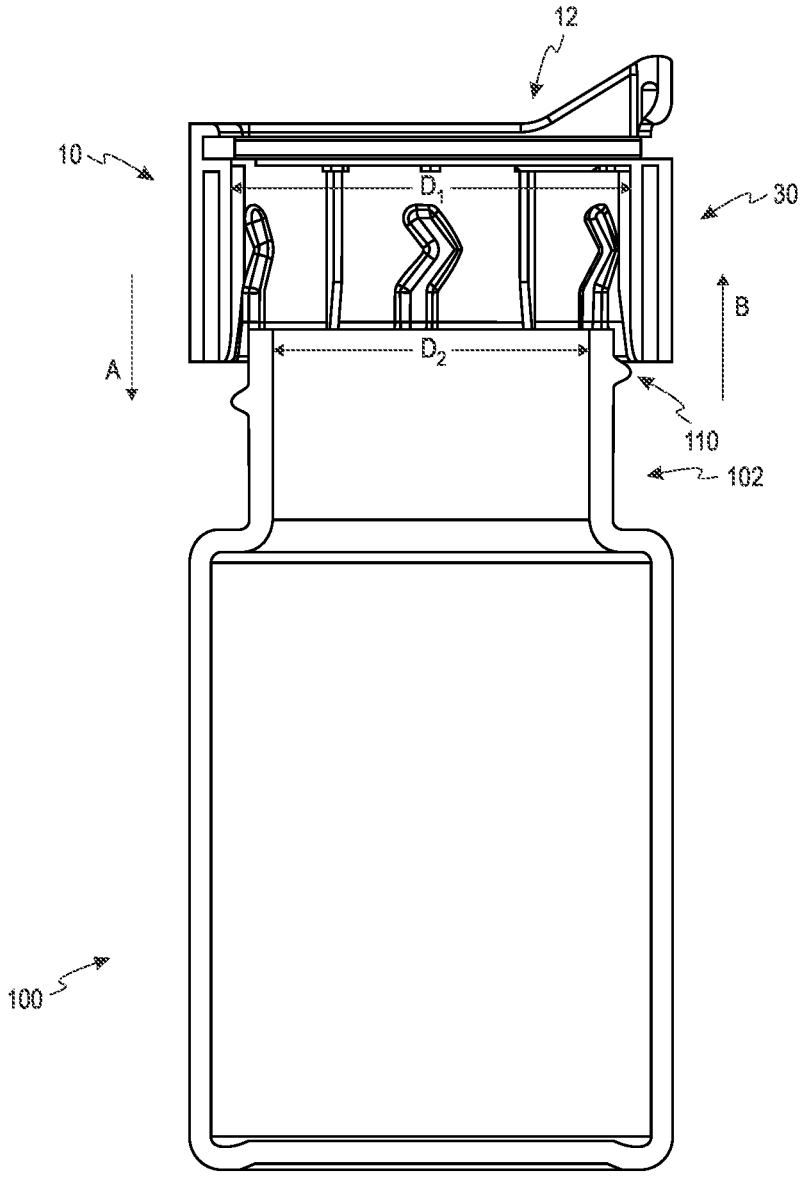
FIG. 5A is a cross-sectional side view of the polymeric closure of FIG. 1A during insertion onto the container of FIG. 4.

The height H3 of the crushable rib 32*b* is at least half of the difference of the inner diameter of the polymeric closure 10 and the outer diameter of the container. The inner diameter D1 of the polymeric closure 10 is shown in FIGS. 1B, 5A, while the outer diameter D2 of the neck portion 102 of the container 100 is shown in FIG. 5A. Thus, the height of the crushable ribs is desirably at least 0.5 multiplied by (D1-D2). The height of the crushable ribs 32 needs to be a balance of the difference of the inner diameter of the polymeric closure 10 and the outer diameter of the container, as well as taking into account the dimensions and shapes of the external threading of the container. The height of the crushable ribs also needs to avoid having too much material that could cause difficulties in properly placing the polymeric closure 10 onto the container during manufacturing, while still having sufficient material to prevent or inhibit a user from removing the polymeric closure 10 from the container 100.

Thus, in summary, when the polymeric closure 10 is threaded onto the container, there is sufficient material from the crushable ribs 32 after being crushed to provide an interference fit that prevents or inhibits axial movement (movement of arrow B in FIG. 5A) of the polymeric closure 10 with respect to the container. This will also be discussed below in further detail with respect to FIG. 6C.

The shape of the crushable ribs 32*b*, 32*d* is shown in FIG. 2A as being an elongated structure with a generally rectangular-shaped cross-section. It is contemplated that the crushable ribs may be an elongated structure with a generally square-shaped cross-section. It is contemplated the crushable ribs may have other polygonal cross-sections. It is also contemplated that the crushable ribs may have non-polygonal cross-sections. For example, the crushable ribs may have a generally half-circle or half-oval cross-section.

The number of the plurality of crushable ribs 32 may vary. As the diameter of the polymeric closure is increased, the number of crushable ribs is typically increased. In one embodiment, the number of crushable ribs is from about 3 to about 12. In another embodiment, the number of crushable ribs is from about from 4 to about 10. In a further embodiment, the number of crushable ribs is from about from 4 to about 8.

The plurality of crushable ribs 32 is located in a generally vertical or vertical orientation from a bottom end 12*b* of the polymeric closure 10 and extending upwardly to the polymeric top portion 12. It is contemplated that other orientations may be used with the crushable ribs.

Figure 3A:
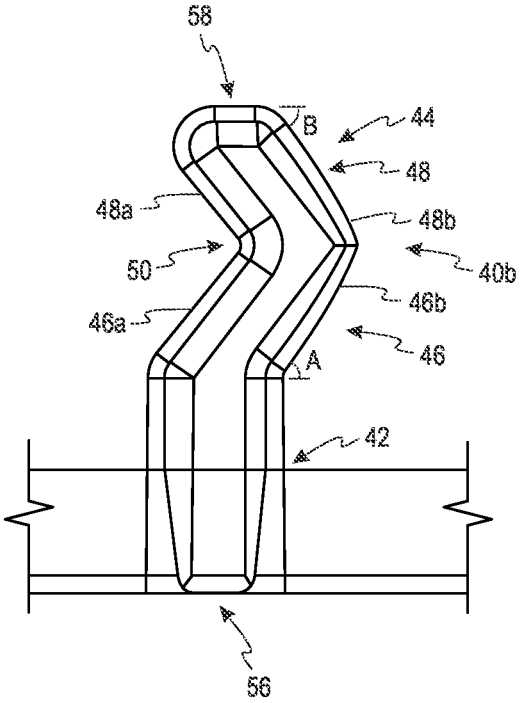
FIG. 3A is a front view of an anti-rotational lug according to one embodiment.
Figure 3B:
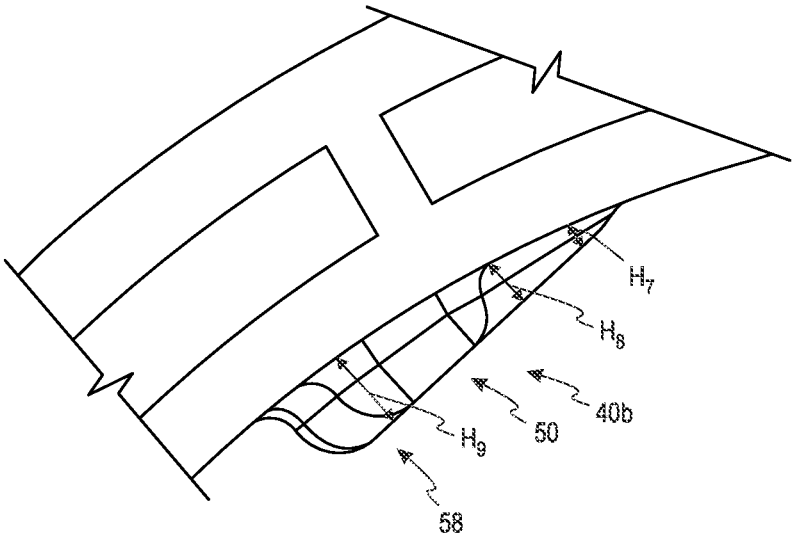
FIG. 3B is a side view of the anti-rotational lug of FIG. 3A.

Each of the anti-rotational lugs 40 is configured to prevent or inhibit rotational movement of the polymeric closure 10 with respect to the container after the polymeric closure 10 has been applied onto the container. At least one of the anti-rotational lugs 40 will prevent or inhibit rotational movement of the polymeric closure 10 with respect to the container after the polymeric closure 10 has been applied onto the container. Referring to FIGS. 3A, 3B, an anti-rotational lug 40*b* is shown. Referring specifically to FIG. 3A, the anti-rotational lug 40*b* has a generally straight or vertical portion 42 and an arrow-shaped portion 44. The arrow-shaped portion 44 may also be referred to as a half diamond or a "greater than" (">") shape.

The arrow-shaped portion 44 is shown as having two straight segments 46, 48 that are angled. The segment 46 is shown to be angled at angle A in FIG. 3A. The angle A of the segment 46 is generally from about 10 to about 80 degrees in one embodiment. In another embodiment, the angle A of segment 46 is generally from about 20 to about 70 degrees and, more typically, from about 30 to 60 degrees. The angle B of segment 48 is generally from about 10 to about 80 degrees in one embodiment. In another embodiment, the angle B of segment 48 is generally from about 20 to about 70 degrees and, more typically, from about 30 to 60 degrees. The first segment 46 has a first exterior side surface 46*a* and a second exterior side surface 46*b*.

The second segment 48 has a first exterior side surface 48*a* and a second exterior side surface 48*b*. The first exterior side surfaces 46*a*, 48*a* meet in a blocking or retaining area 50. The blocking area 50 of the first and second segments 46, 48 of the anti-rotational lug 40*b* forms an area that prevents or inhibits a user from further unthreading of the polymeric closure 10 with respect to the container. More specifically, if a user attempts to unthread the polymeric closure 10 with respect to the container, a leading edge of the external threading of the container will contact and catch the blocking area 50 of at least one of the anti-rotational lugs, which prevents or inhibits further rotation of the polymeric closure 10 with respect to the container.

Thus, after the polymeric closure 10 is positioned on the container in manufacturing, the amount of unthreading depends on the distance between the leading edge of the external threading of the container and the blocking area. After the closure 10 is positioned on a container that uses a single continuous helical thread in manufacturing, only one of the blocking areas of the plurality of anti-rotational lugs will be used if a user attempts to unthread the closure 10 with respect to the container. This will be the anti-rotational lug closest to the leading edge of the external threading of the container in the direction of travel for unthreading. Having a greater number of anti-rotational lugs will also decrease, on average, the amount of rotation that can occur between the polymeric closure 10 before being blocked or retained.

The travel for unthreading is counter-clockwise for a user when the polymeric closure is placed onto the container in a clockwise manner during manufacturing. It is contemplated in another method that the unthreading is clockwise for a user when the polymeric closure is placed onto the container in a counter-clockwise manner during manufacturing.

Figure 2B:
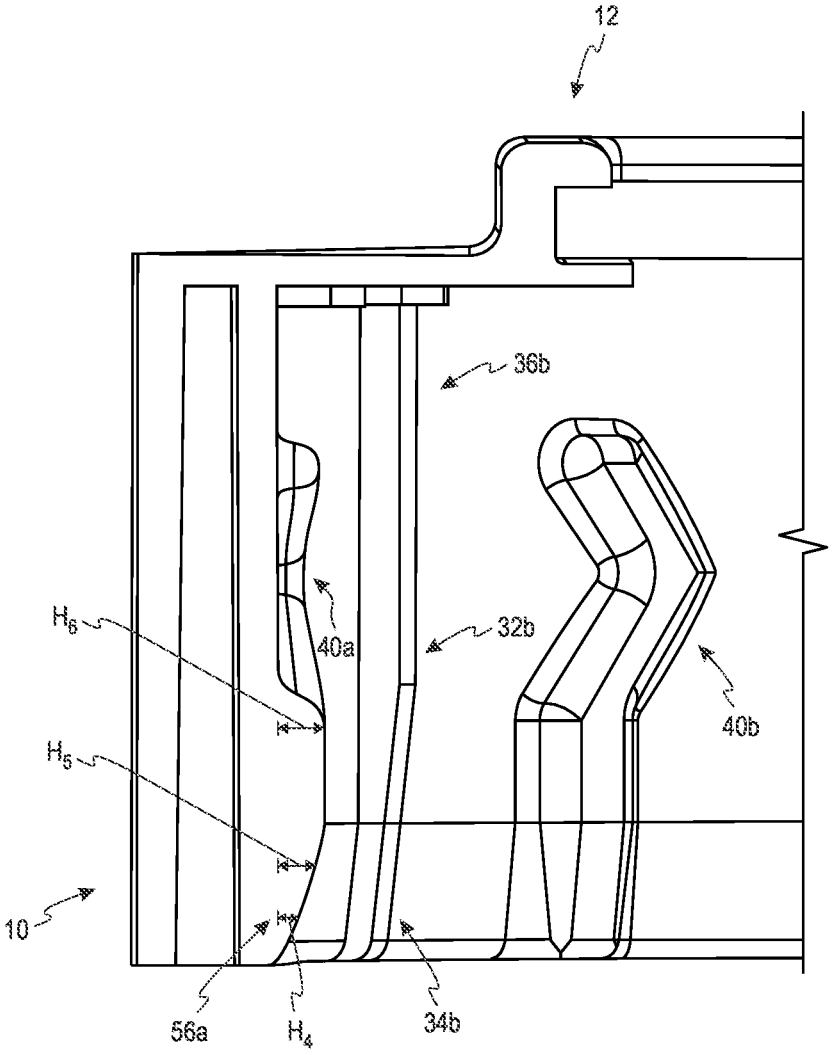
FIG. 2B is another interior side view of the polymeric closure of FIG. 1A according to one embodiment.

The anti-rotational lug 40*a* of FIG. 2B has a tapered/chamfered surface on its leading edge or end 56*a* to aid in threading the closure 10 onto the container. Like the plurality of crushable ribs 32, the leading edge or end 56*a* of the anti-rotational lug 40*a* is shown as being tapered or chamfered to assist in properly centering the polymeric closure 10 with respect to the container and avoiding potential deflection thereof. The leading edge or end 56*a* of the anti-rotational lug 40*a* is the edge or end that is opposite of the polymeric top portion 12 of the polymeric closure 10. By having the leading edge or end 56*a* of the anti-rotational lug 40*a* being tapered or chamfered, this assists in more smoothly placing the polymeric closure 10 onto a container.

The tapering or chamfering of the leading edge or end 56*a* of the anti-rotational lug 40*a* is best shown by comparing heights H4, H5 and H6 of FIG. 2B in different locations of the anti-rotational lug 40*a*. The height H4 of the anti-rotational lug 40*a* is less than the height H5, and the height H5 is less than the height H6.

The anti-rotational lugs 40 (including anti-rotational lug 40*b*) also have side chamfering or tapering. Specifically, as shown in FIG. 3A, the second exterior side surface 48*b* of the second segment 46 has a tapered/chamfered edge. This assists in more smoothly threading the polymeric closure 10 onto the container. It is also contemplated that the second exterior side surface 46*b* of the first segment 46 may also be chamfered or tapered. When the polymeric closure 10 is threaded onto the container, the threads should be designed to thread over at least some, if not most, of the anti-rotational lugs. In one method, one or more anti-rotational lug will remain in its general original state without contacting the external thread formation initially. In another method, each of the anti-rotational lugs will contact the external thread formation when inserting the closure onto the container. It is noted that one of the anti-rotational lugs, if contacted, will be at the end nearest the polymeric top portion. The remaining anti-rotational lugs 40 will not be used for preventing or inhibiting rotational movement of the closure 10 with respect to the container, but will be used as an additionally interference fit to further assist the crushable ribs 32.

As shown in FIGS. 3A, 3B, the anti-rotational lug 40*b* is designed with the blocking area 50 having a substantially vertical or vertical surface on the first exterior side surfaces 46*a*, 48*a*. The blocking area 50 is also undercut in one embodiment, which assists in blocking the external thread formation of the container. The blocking area is aligned with a similar radial orientation/height of the leading edge of the external thread of the container. When the closure 10 is rotated in the opening direction, the blocking area 50 engages with the leading edge of the external thread formation of the container and prevents or inhibits further rotation after that engagement.

The number of the plurality of anti-rotational lugs 40 may vary. As the diameter of the closure is increased, the number of anti-rotational lugs is typically increased. In one embodiment, the number of anti-rotational lugs is from about 3 to about 12. In another embodiment, the number of anti-rotational lugs is from about from 4 to about 10. In a further embodiment, the number of anti-rotational lugs is from about from 4 to about 8.

Having the closure with anti-rotational lugs is advantageous when the product being stored with the container is not desirable for certain individuals (e.g., medicine for children). By having the plurality of crushable ribs and the plurality of anti-rotational lugs, it allows for a myriad of product-dispensing devices to be applied to existing containers. These containers may be, for example, child-resistant containers, tamper-proof containers, and over-the-counter containers.

It is contemplated that the anti-rotational lugs may be shaped different than depicted in FIGS. 3A, 3B. In one embodiment, the anti-rotational lugs include a half circle ("(") or half oval shape that forms a blocking area. In another embodiment, the anti-rotational lugs have a right bracket ("]") shape that forms a blocking area. It is contemplated that the anti-rotational lugs may be other shapes that are configured to block the leading edge of the external threads of the container.

It is noted that if the threading direction is reversed, the anti-rotational lugs will be modified to have the blocking area on the proper side. In one embodiment, the anti-rotational lugs may include an arrow-shaped portion ("<") in one embodiment. In another embodiment, the anti-rotational lugs include a half circle ("(") or half oval shape that forms a blocking area. In a further embodiment, the anti-rotational lugs have a left bracket ("[") shape that forms a blocking area.

To access the polymeric closure 10 (i.e., to open the closure), the polymeric closure 10 is configured to have an opening formed therein. The opening of the polymeric closure may be a slidable lid in one embodiment. The opening of the polymeric closure in another embodiment may be a rotatable, flipped or hinged lid.

The polymeric closure 10 may also include tamper-evident features. More specifically, the tamper-evident features show visual identification to a user that the closure may have been opened and the product potentially been accessed. For example, these features would prevent or inhibit the opening from being accessed. It is contemplated that other tamper-evident features may be added to the polymeric closure.

It is contemplated that the polymeric closure may also include a liner located on an interior surface of the top wall portion. The liner is typically made of compressible polymeric material and provides sealing for the closure. In one embodiment, the liner is a polymeric foam liner. In other embodiments, other sealing mechanisms can be used in conjunction with the polymeric closure. For example, in one embodiment, an interior surface of the top wall portion may include a polymeric continuous plug seal and/or an outer seal. The polymeric continuous plug seal and/or the outer seal depend from the polymeric top portion and provide a sealing mechanism. It is contemplated that other sealing mechanisms may be used in the polymeric closure.

The closure may include an oxygen-scavenger material. This oxygen-scavenger material may be distributed within the closure or may be a separate layer. The oxygen-scavenger material may be any material that assists in removing oxygen within the container, while having little or no effect on the contents within the container.

Alternatively, or in addition to, the closure may include an oxygen-barrier material. The oxygen-barrier material may be added as a separate layer or may be integrated within the closure itself. The oxygen-barrier materials assist in preventing or inhibiting oxygen from entering the container through the closure. These materials may include, but are not limited to, ethylene vinyl alcohol (EVOH). It is contemplated that other oxygen-barrier materials may be used in the closure.

Figure 4:
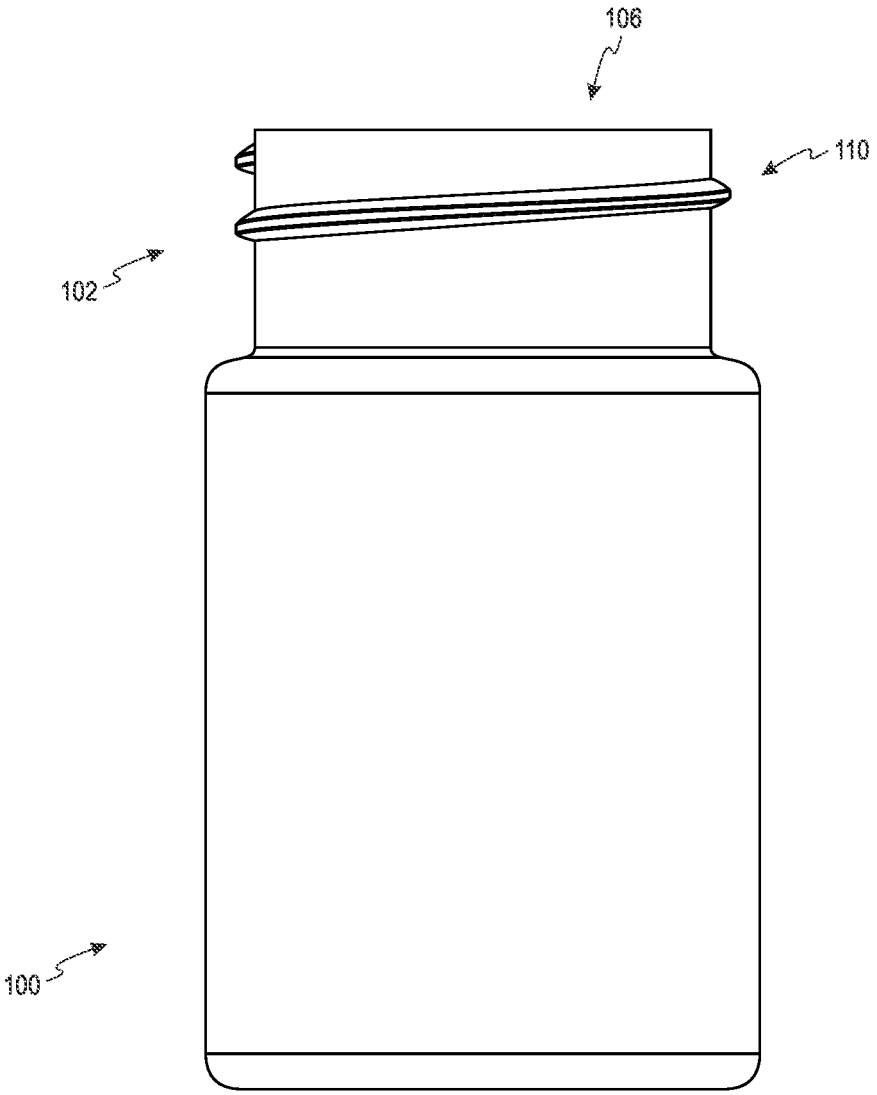
FIG. 4 is a side view of the container according to one embodiment.

Referring to FIG. 4, a container 100 is shown that includes a neck portion 102 defining an opening 106. The neck portion 102 of the container 100 includes an external thread formation 110. Since the polymeric closure 10 does not include internal threads, the polymeric closure will not be in threading engagement with the external thread formation of the container.

The external thread formation 110 is one continuous helical thread in this embodiment as shown in FIG. 4. In another embodiment, the external thread formation includes a first container lead and a second container lead, which are referred collectively as a double lead closure thread. Each of the first and second container leads may be continuous. The first and second helical container leads may be helical. It is contemplated that the first and second container leads may be discontinuous.

It is also contemplated that the external thread formation of the container may differ from a helical thread formation. It is also contemplated that other external thread formations may be used in the container. For example, the external thread formation may include a triple-threaded structure having first, second and third closure leads.

It is contemplated that other features may be included on the neck portion 102. Some non-limiting examples include retention lugs, A-collar for banded applications, and splines.

The polymeric closure 10 may be assembled to the container 100 using existing manufacturing methods. More specifically, in one method, the closure 10 is grabbed by a clutch on its outer diameter and is continuously rotated as being placed on a container that is being held in place.

Referring to FIG. 5A, the process of placing or threading the polymeric closure 10 onto the container 100 is shown. The polymeric closure 10 is shown being moved in the direction of arrow A. FIG. 5A also shows that the outer diameter D2 of the neck portion 102 is smaller than the inner diameter D1 of the polymeric closure 10.

Figure 5B:
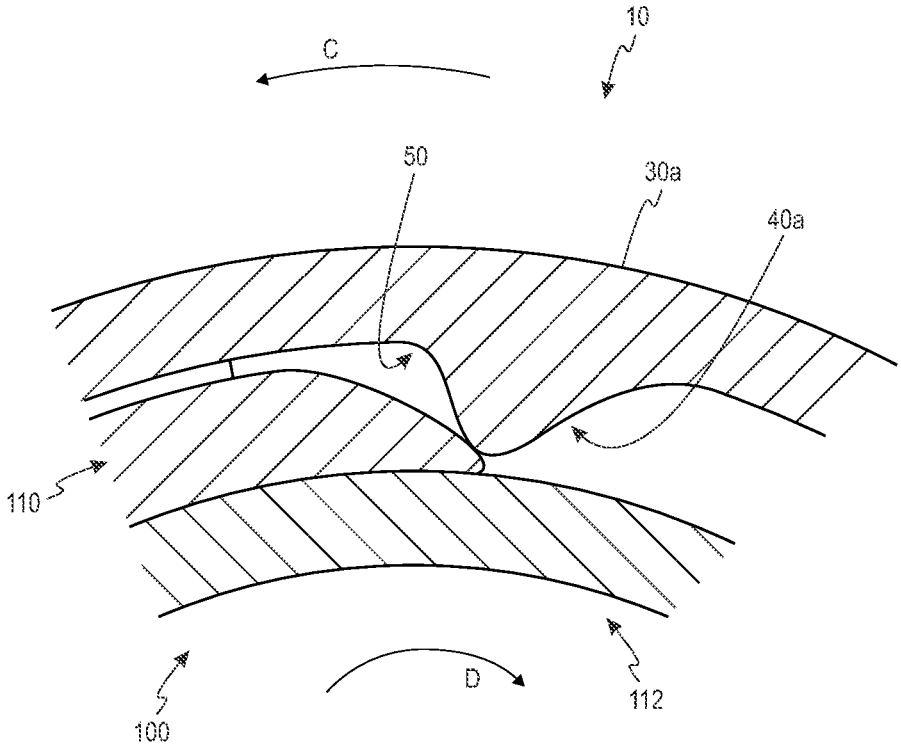
FIG. 5B is an enlarged cross-sectional top view showing an external thread formation of the container contacting an anti-rotational lug.
Figure 5C:
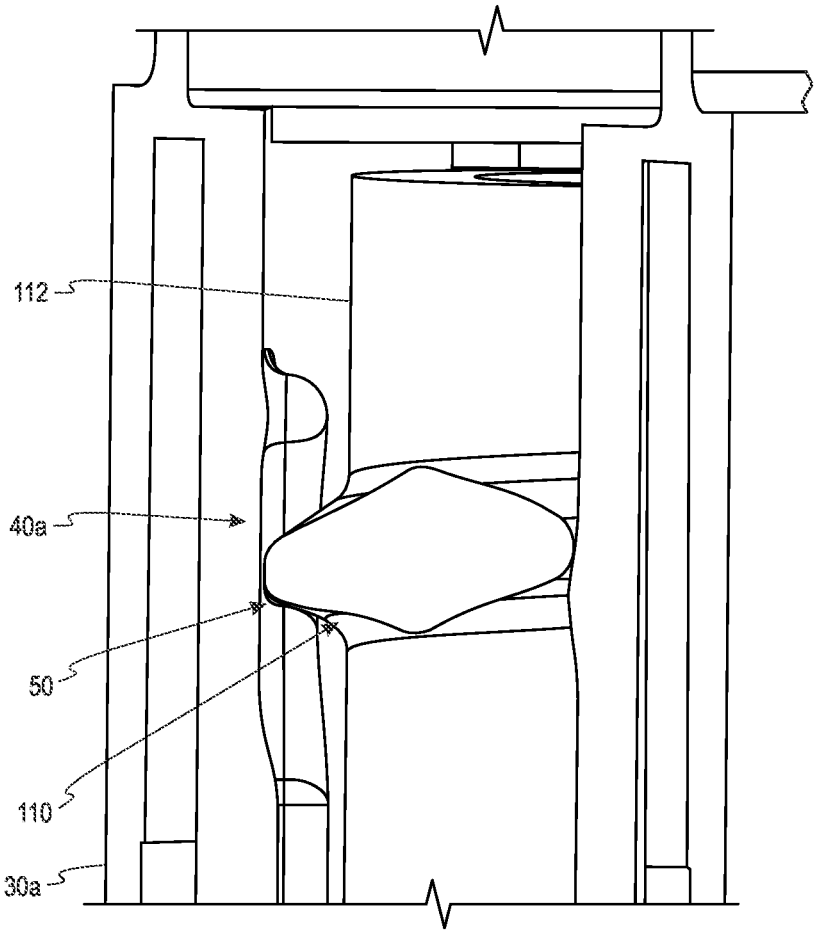
FIG. 5C is an enlarged cross-sectional side view showing an external thread formation of a container contacting an anti-rotational lug.

FIGS. 5B, 5C show a blocking area 50 of the anti-rotational lug 40*a* blocking a leading edge of the external thread formation 110 that prevents or inhibits a user from further unthreading of the polymeric closure 10 with respect to the container. Arrow C indicates the clockwise direction in which the polymeric closure 10 is applied, while arrow D indicates the counter-clockwise direction of unthreading in which the external thread formation 110 has contacted the blocking area 50.

In one embodiment, a package comprises a container with an opening and a polymeric closure. The polymeric closure is configured for fitment to a neck portion of the container for closing the opening. The closures are configured to be placed on a container or bottle that contain product. The product may be a liquid product, but typically is a solid product. In another embodiment, the product may be a combination of a liquid and solid product. Some products that may be especially desirable to use include dispensable tablets such as over-the-counter (OTC) medication, vitamins, prescriptions, etc.

One non-limiting example of a closure and a container forming a package is shown in FIGS. 6A-6C. FIG. 6A is a top perspective view of the package 200 including the polymeric closure 10 of FIG. 1A and the container 100 of FIG. 4 in a closed position. FIG. 6A also shows a slidable lid 60 for opening the closure and accessing the product in the container 100. FIG. 6B is a side view of the package 200 including the polymeric closure 10 of FIG. 1A and the container 100 of FIG. 4 in a closed position.

FIG. 6C shows a general cross-sectional view of the package 200 in the neck portion 102 of the container 100 and the polymeric closure 10. The polymeric closure 10 includes the slidable lid 60 in an open position, allowing an opening to be accessed by a user. FIG. 6C also shows that the crushable ribs 32*c*, 32*f* having been deformed by the external thread formation 110. This results in preventing or inhibiting the user from separating the polymeric closure 10 from the container 100 by lifting in an axial direction (arrow B).

The closure is typically made of polymeric material, such as olefin (e.g., polyethylene (PE), polypropylene (PP)), polyethylene terephthalate (PET) or blends thereof. One example of a polyethylene that may be used is high density polyethylene (HDPE). It is contemplated that the closure may be made of other polymeric materials.

The closures are typically formed by processes such as injection or compression molding.

The container 100 is typically made of polymeric material. One non-limiting example of a material to be used in forming a polymeric container is polyethylene terephthalate (PET), polypropylene (PP) or blends using the same. It is contemplated that the container may be formed of other polymeric or copolymer materials. The container 100 is typically have an encapsulated oxygen-barrier layer or oxygen barrier material incorporated therein.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

What is claimed is:

1. A closure for use with a container, the closure comprising:

a polymeric top portion; and a polymeric annular skirt portion depending from the polymeric top portion, the polymeric annular skirt portion including an exterior surface and an interior surface, the interior surface of the polymeric annular skirt portion including a plurality of crushable ribs and a plurality of anti-rotational lugs, wherein the plurality of crushable ribs is configured to be crushed when the closure is applied to the container so as to prevent or inhibit axial movement of the closure with respect to the container by forming an interference fit, wherein at least one of the plurality of anti-rotational lugs prevents or inhibits rotational movement of the closure with respect to the container such that the closure remains on the container, wherein each of the plurality of the crushable ribs has a height at a first end closer to the polymeric top portion that is greater than each of the heights of the plurality of crushable ribs at a second opposing end.

2. The closure of claim 1, wherein each of the plurality of crushable ribs has a tapered or chamfered end, the tampered or chamfered end being located opposite of the polymeric top portion.

3. The closure of claim 1, wherein each of the plurality of crushable ribs has a polygonal cross-sectional shape.

4. The closure of claim 3, wherein each of the plurality of crushable ribs has a rectangular cross-sectional shape.

5. The closure of claim 1, wherein the number of the plurality of crushable ribs is from about 3 to about 12.

6. The closure of claim 5, wherein the number of the plurality of crushable ribs is from about 4 to about 8.

7. The closure of claim 1, wherein the plurality of anti-rotational lugs includes an arrow-shaped portion.

8. The closure of claim 1, wherein each of the plurality of anti-rotational lugs has a tapered or chamfered end, the tampered or chamfered end being located opposite of the polymeric top portion.

9. The closure of claim 1, wherein the number of the plurality of anti-rotational lugs is from about 3 to about 12.

10. The closure of claim 9, wherein the number of the plurality of anti-rotational lugs is from about 4 to about 8.

11. The closure of claim 1, wherein the closure is a one-piece closure.

12. A package comprising:

a container having a neck portion defining an opening, the neck portion having an exterior surface and an interior surface; and a closure being configured for fitment to the neck portion of the container for closing the opening, the closure including a polymeric top portion and a polymeric annular skirt portion, the polymeric annular skirt portion depending from the polymeric top portion, the polymeric annular skirt portion including an exterior surface and an interior surface, the interior surface of the polymeric annular skirt portion including a plurality of crushable ribs and a plurality of anti-rotational lugs, wherein the plurality of crushable ribs is configured to be crushed when the closure is applied to the container so as to prevent or inhibit axial movement of the closure with respect to the container by forming an interference fit, wherein at least one of the plurality of anti-rotational lugs prevents or inhibits rotational movement of the closure with respect to the container such that the closure remains on the container, wherein each of the plurality of the crushable ribs has a height at a first end closer to the polymeric top portion that is greater than each of the heights of the plurality of crushable ribs at a second opposing end.

13. A package comprising:

a container having a neck portion defining an opening, the neck portion having an exterior surface and an interior surface; and a closure being configured for fitment to the neck portion of the container for closing the opening, the closure including a polymeric top portion and a polymeric annular skirt portion, the polymeric annular skirt portion depending from the polymeric top portion, the polymeric annular skirt portion including an exterior surface and an interior surface, the interior surface of the polymeric annular skirt portion including a plurality of crushable ribs and a plurality of anti-rotational lugs, wherein the plurality of crushable ribs is configured to be crushed when the closure is applied to the container so as to prevent or inhibit axial movement of the closure with respect to the container by forming an interference fit, wherein at least one of the plurality of anti-rotational lugs prevents or inhibits rotational movement of the closure with respect to the container such that the closure remains on the container, wherein each of the plurality of anti-rotational lugs has a height at a first end closer to the polymeric top portion that is greater than each of the heights of the plurality of anti-rotational lugs at a second opposing end.

14. A package comprising:

a container having a neck portion defining an opening, the neck portion having an exterior surface and an interior surface; and a closure being configured for fitment to the neck portion of the container for closing the opening, the closure including a polymeric top portion and a polymeric annular skirt portion, the polymeric annular skirt portion depending from the polymeric top portion, the polymeric annular skirt portion including an exterior surface and an interior surface, the interior surface of the polymeric annular skirt portion including a plurality of crushable ribs and a plurality of anti-rotational lugs, wherein the plurality of crushable ribs is configured to be crushed when the closure is applied to the container so as to prevent or inhibit axial movement of the closure with respect to the container by forming an interference fit, wherein at least one of the plurality of anti-rotational lugs prevents or inhibits rotational movement of the closure with respect to the container such that the closure remains on the container, wherein each of the plurality of anti-rotational lugs has an exterior side surface being tapered or chamfered at a section closest to the polymeric top portion, wherein each of the plurality of anti-rotational lugs has an opposing exterior side surface being a substantially vertical wall at a section closest to the polymeric top portion.

15. A closure for use with a container, the closure comprising:

a polymeric top portion; and a polymeric annular skirt portion depending from the polymeric top portion, the polymeric annular skirt portion including an exterior surface and an interior surface, the interior surface of the polymeric annular skirt portion including a plurality of crushable ribs and a plurality of anti-rotational lugs, wherein the plurality of crushable ribs is configured to be crushed when the closure is applied to the container so as to prevent or inhibit axial movement of the closure with respect to the container by forming an interference fit, wherein at least one of the plurality of anti-rotational lugs prevents or inhibits rotational movement of the closure with respect to the container such that the closure remains on the container, wherein each of the plurality of anti-rotational lugs has a height at a first end closer to the polymeric top portion that is greater than each of the heights of the plurality of anti-rotational lugs at a second opposing end.

16. The closure of claim 15, wherein the number of the plurality of crushable ribs is from about 3 to about 12.

17. The closure of claim 15, wherein the plurality of anti-rotational lugs includes an arrow-shaped portion.

18. The closure of claim 15, wherein each of the plurality of anti-rotational lugs has a tapered or chamfered end, the tampered or chamfered end being located opposite of the polymeric top portion.

19. The closure of claim 15, wherein the number of the plurality of anti-rotational lugs is from about 3 to about 12.

20. The closure of claim 15, wherein the closure is a one-piece closure.

21. A closure for use with a container, the closure comprising:

a polymeric top portion; and a polymeric annular skirt portion depending from the polymeric top portion, the polymeric annular skirt portion including an exterior surface and an interior surface, the interior surface of the polymeric annular skirt portion including a plurality of crushable ribs and a plurality of anti-rotational lugs, wherein the plurality of crushable ribs is configured to be crushed when the closure is applied to the container so as to prevent or inhibit axial movement of the closure with respect to the container by forming an interference fit, wherein at least one of the plurality of anti-rotational lugs prevents or inhibits rotational movement of the closure with respect to the container such that the closure remains on the container, wherein each of the plurality of anti-rotational lugs has an exterior side surface being tapered or chamfered at a section closest to the polymeric top portion, wherein each of the plurality of anti-rotational lugs has an opposing exterior side surface being a substantially vertical wall at a section closest to the polymeric top portion.

22. The closure of claim 21, wherein the number of the plurality of crushable ribs is from about 3 to about 12.

23. The closure of claim 21, wherein the plurality of anti-rotational lugs includes an arrow-shaped portion.

24. The closure of claim 21, wherein each of the plurality of anti-rotational lugs has a tapered or chamfered end, the tampered or chamfered end being located opposite of the polymeric top portion.

25. The closure of claim 21, wherein the number of the plurality of anti-rotational lugs is from about 3 to about 12.

26. The closure of claim 21, wherein the closure is a one-piece closure.

* * * * *